United States Patent [19]

Narita et al.

[11] Patent Number: 4,732,529

[45] Date of Patent: Mar. 22, 1988

[54] TURBOMOLECULAR PUMP

[75] Inventors: Kiyoshi Narita; Jyuichi Kawaguchi, both of Kyoto, Japan

[73] Assignee: Shimadzu Corporation, Kyoto, Japan

[21] Appl. No.: 31,193

[22] Filed: Mar. 27, 1987

Related U.S. Application Data

[63] Continuation of Ser. No. 705,000, Feb. 25, 1985, abandoned.

[30] Foreign Application Priority Data

Feb. 29, 1984 [JP] Japan ..... 59-38958
Feb. 29, 1984 [JP] Japan ..... 59-38959

[51] Int. Cl.[4] ..... F01D 1/36
[52] U.S. Cl. ..... 415/90
[58] Field of Search ..... 415/90, 143, 199.5; 416/175 R, 203

[56] References Cited

U.S. PATENT DOCUMENTS

| | | | |
|---|---|---|---|
| 969,541 | 9/1910 | Matzenik et al. | 415/199.5 |
| 2,730,297 | 1/1956 | Van Dorsten et al. | 415/90 |
| 3,628,894 | 12/1971 | Ferguson | 415/90 |
| 3,751,908 | 8/1973 | Colwell et al. | 415/90 |
| 3,947,193 | 3/1976 | Maurice | 415/90 |
| 3,969,039 | 7/1976 | Shoulders | 415/90 |
| 4,023,920 | 5/1977 | Bachler et al. | 415/90 |
| 4,111,595 | 9/1978 | Backer et al. | 415/90 |
| 4,332,522 | 6/1982 | Sawgeot | 415/90 |

FOREIGN PATENT DOCUMENTS

| | | | |
|---|---|---|---|
| 2310481 | 3/1976 | France | 415/90 |
| 4733446 | 8/1972 | Japan . | |
| 4733447 | 8/1972 | Japan . | |

OTHER PUBLICATIONS

"Recent State in Turbomolecular Pump Development", Proc. 7th Intern. Vac. Congr. & 3rd Intern. Conf. Solid Surfaces, (Vienna, 1977), pp. 25 through 32.

*Primary Examiner*—Robert E. Garrett
*Assistant Examiner*—John T. Kwon
*Attorney, Agent, or Firm*—Armstrong, Nikaido, Marmelstein & Kubovcik

[57] ABSTRACT

A turbomolecular pump for performing exhaustion by rotating rotors, which pump comprises a blade group consisting of alternately arranged rotors and stators blades and which has a compression ratio raising section in said blade group at a portion on the exhaust port side or an intermediate portion. The compression ratio raising section comprising a rotor whose blade is thicker than a rotor located closer to the suction port side. This turbomolecular pump has good pumping efficiency for lower vacuum range.

5 Claims, 11 Drawing Figures

TURBOMOLECULAR PUMP

This application is a continuation of application Ser. No. 705,000, filed 2-25-85, now abandoned.

BACKGROUND OF THE INVENTION

The present invention relates to a turbomolecular pump which can attain a good pumping efficiency even in a low vacuum range. As described in "Recent State in Turbomolecular Pump Development" in the pages 25 through 32 of the Proc. 7th Intern. Vac. Congr. & 3rd Intern. Conf. Solid Surfaces (Vienna 1977), the turbomolecular pump is designed to mechanically blow gas molecules for exhaustion thereby achieving ultra-high vacuum. To this purpose, the pump body comprises rotors consisting of inclined blades rotatable at a high speed and stators consisting of blades inclined in the inverse direction to the rotors brades. And these rotors and stators are arranged alternately, usually, in multiple stages.

With this type of pump, however, since the compression ratio in the multiple stage blades is low, the pumping performance drops seriously in a low vacuum range (as the vacuum approaches atmospheric pressure). To reduce this disadvantage, a number of rotor and stator blades may be axially provided to define the pump body. However, this construction results in a heavy weight, interferring with high-speed rotation, and is disadvantageous in terms of cost. Specifically, with conventional turbomolecular pumps, the pumping speed suddenly drops at a vacuum of $10^{-3} \sim 10^{-2}$ Torr and becomes virtually zero at a vacuum of about 0.1 Torr. When a turbomolecular pump is to be operated in a low vacuum range, therefore, it has been general to connect auxilliary vacuum pumps such as a mechanical booster pump and a rotary pump, as appropriate, to the turbomolecular pump, so that the pumping capacity is compensated.

So-called a hybrid turbomolecular pump has been also developed to reduce the necessity of these backing pumps. This type of pump comprises a group of rotor and stator blades staggered on the suction port side and a stator having spiral thread groove on the exhaust port side for guiding gas sent from said group of the blades to the atmosphere. The depth of the thread groove is formed so that is gradually becomes shallower (toward the exhaust port) to increase the compression ratio. With this hybrid pump, the pump body itself does not still provide a compression ratio raising function and requires a stator with complex thread groove, thus involving complicated machining work for manufacture.

Though the hybrid turbomolecular pump attains good pumping efficiency in a low vacuum range, it presents a new problem. Specifically, the hybrid pump is so designed that gas molecules are discharged as guided along the long passage defined by said spiral thread groove, with circumferential momentum given to the gas molecules on the rotor surface. This passage in the spiral groove has no node on the way, thus allowing gas molecules to flow in any direction. As a result, backstreaming of molecules is easily caused so that ultimate vacuum achieved may be deteriorated.

SUMMARY OF THE INVENTION

The present invention has been made with the aforementioned technical background. The primary object of the invention is to provide a turbomolecular pump in which the construction of the blades has been improved to have compression ratio raising function, so that pumping operation for lower vacuum range is possible.

The second object of the invention is to provide a turbomolecular pump that can eliminate the disadvantages without sacrificing the advantages of the hybrid turbomolecular pump so that the pump attains good pumping speed efficiency even in a low vacuum range, free from backstreaming of gas molecules that could deteriorate the ultimate vacuum achieved.

To this purpose, the turbomolecular pump according to this invention is composed of alternately arranged rotor and stator blades, said rotor blades being rotated at a high speed for exhaustion, and characterized by a compression ratio raising section formed in the middle or toward the exhaust port side of the group of the blades, the rotor blades at the compression ratio raising section being thicker than those near the suction port side.

As more effective embodiment of the present invention, the rotor blades at the compression ration raising section are formed so that they become gradually shorter toward the exhaust port side. As another effective embodiment of the invention, the hybrid turbomolecular pump contains a compression ratio raising section composed of a rotors having thread grooves and ring grooves. In other words, the turbomolecular pump comprises alternately arranged rotor and stator blades on the suction port side and a compression ratio raising section is provided with a rotor whose blades (turbine blades) consist of spiral grooves and are divided by ring grooves and by stator rings projecting from the wall surrounding the screw rotor into said ring grooves.

DESCRIPTION OF THE PREFERRED EMBODIMENT

The first example of the present invention will be explained in the following with reference to drawings.

Figure 1:
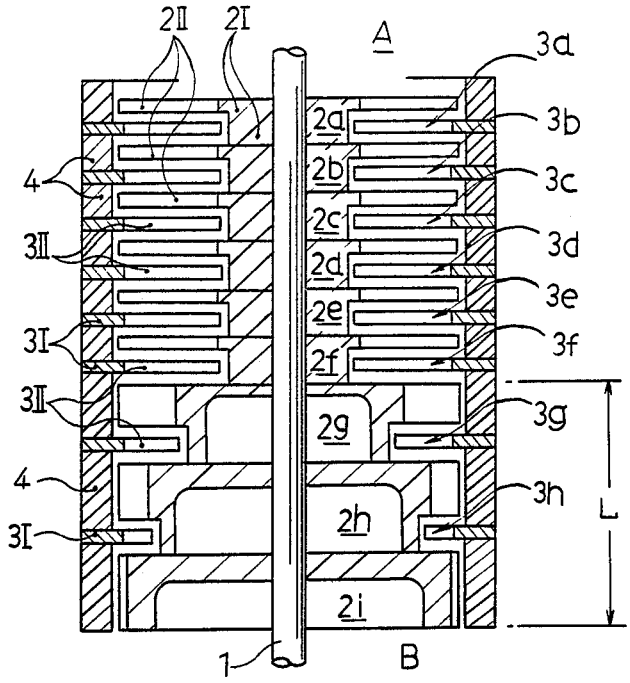
FIG. 1 is a vertical sectional view of the pump body (blades) as a first example of the present invention, and FIGS. 2(A) and (B) are a plan view and a side view respectively of an example of the rotor in FIG. 1.
Figure 2A:
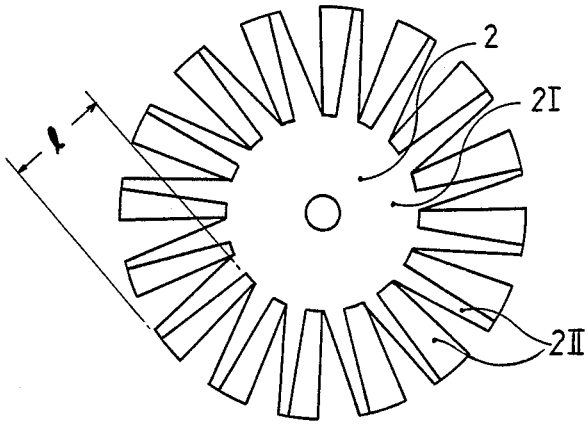
Figure 2B:
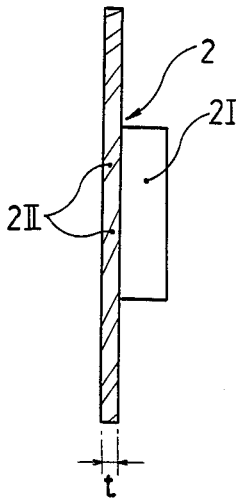

FIG. 1 shows the construction of the major part of the turbomolecular pump relating to the first example of the present invention. As shown, rotors 2*a*, 2*b*, . . . , 2*i* are fitted and fixed successively to the driving shaft 1 located in the center and driven by a motor (not shown), each of said rotors comprising blades 2 II radially projecting from the periphery of the disk 21 and inclined by a predetermined angle as shown in FIG. 2A and 2B. Stators 3*a*, 3*b*, . . . , 3*h* are positioned and fixed with each of the base portions 3I clamped by annular spacers 4, 4 around said rotors 2*a*, 2*b*, . . . so that the blades 3 II of each of said stators having inverse inclination with said rotor blades 2 II are positioned between said rotor blades 2 II, 2 II. Thus, the required number of the rotors 2*a*, 2*b*, . . . and the stators 3*a*, 3*b*, . . . are alternately arranged to form the pump body. With this turbomolecular pump, when the rotor blades 2 II rotate at a high speed, driven through the driving shaft 1, they collide with gas molecules and give axial momentum to the same, thus generating forced molecule flow, in cooperation with said stator blades 3 II, from the suction port A at one end to the exhaust port B at the other end of the pump, so that gas is discharged.

It is general in conventional turbomolecular pumps that the blade thickness t and the blade length l of the rotors are constant through the entire axial length of the pump or that the blade length is changed between adjacent two blades 2 II, 2 II to form a step in the middle of the entire axial length of the pump.

Figure 3A:
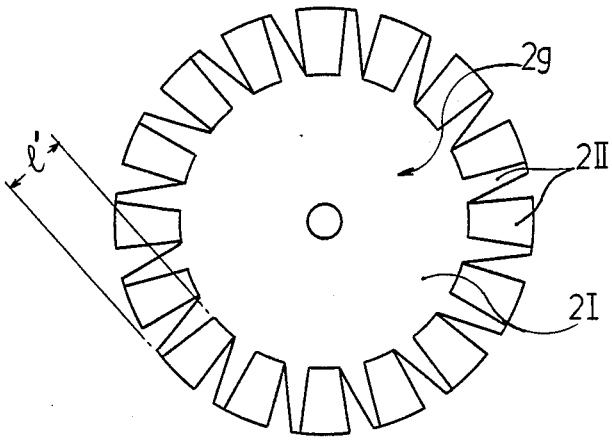
FIGS. 3(A) and (B) are a plan view and a side view respectively of an example of the rotor in the compression ratio raising section (4) of the turbomolecular pump shown in FIG. 1.
Figure 3B:
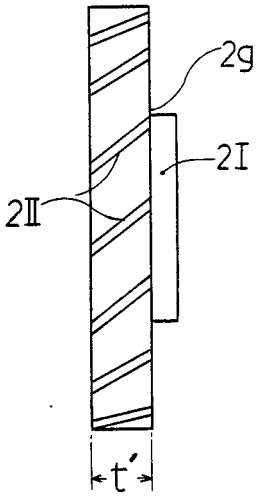

Unlike these conventional types, the pump in the first example includes a compression ratio raising section in which the length 1 and the thickness t of the rotor blades are gradually changed. Specifically, the rotors arranged on the suction port side A (2*a*~2*f*) have the same length and thickness as shown in FIG. 2A and 2B, whereas those on the exhaust port side B (2*g*~2*i*) have length 1′ and thickness t′ quite different from those of the rotors on the side A as shown in FIG. 3A and 3B; the blade length and the thickness of these rotors on the side B become shorter and larger respectively toward the exhaust port side B to define the compression ratio raising section in the portion L shown in FIG. 1. Thus, the compression ratio is raised effectively in this portion. Accordingly, the pump in the first example, in which only a few rotors on the exhaust port side B have different length and thickness from the rest, can attain the same performance as a conventional screw rotor-equipped hybrid turbomolecular pump. This is because the compression ratio increases with the blade thickness t of the rotor 2 in the compression ratio raising section L. Moreover, since the blade length 1 of the rotors 2 is made shorter toward the exhaust port side B in said compression ratio raising section L, the depth of the passage guiding gas molecules becomes gradually smaller. Thus, the compression ratio for the exhaust gas sent by rotor blades 2 II and stator blades 3 II alternately is raised by every stage of the rotors, so that the pumping operation is effective for lower vacuum range. More specifically, for a vacuum of about $10^{-3} \sim 10^{-2}$ Torr, the pump can achieve nearly the same pumping speed as for a vacuum of $10^{-2}$ Torr or smaller. It still retains somehow effective pumping speed even for about 0.1 Torr vacuum. Therefore, when this pump is used, it is not necessary any more to install a number of auxiliary vacuum pumps as it has been for conventional pumps. Simple exhaustion system consisting of, for example, a turbomolecular pump and a rotary pump is enough to yield a satisfactory result. Thus, the invention realizes a simplified and low cost exhaustion system. In addition, according to this example, because the compression ratio is increased in the compression ratio raising section it is not necessary to use a stator with complex thread groove as it has been for a conventional hybrid pump. Besides, each rotor in the compression ratio raising section has blades of an identical length and does not require complicated machining work to give spiral thread groove. Therefore, the entire construction of the pump is simple and small.

In this example, the compression ratio raising section is formed by the rotors on the exhaust port side B. It may be formed in any portion along the axial length of the pump only so long as at least one compression ratio raising section. It is desirable, however, that the length of the rotor blades on the suction port side A is constant to ensure the required pumping speed. According to the example shown, the thickness of the stator blades is constant. But where the thickness of the rotor blades becomes gradually larger, the stator blade thickness may be increased accordingly.

Figure 4:
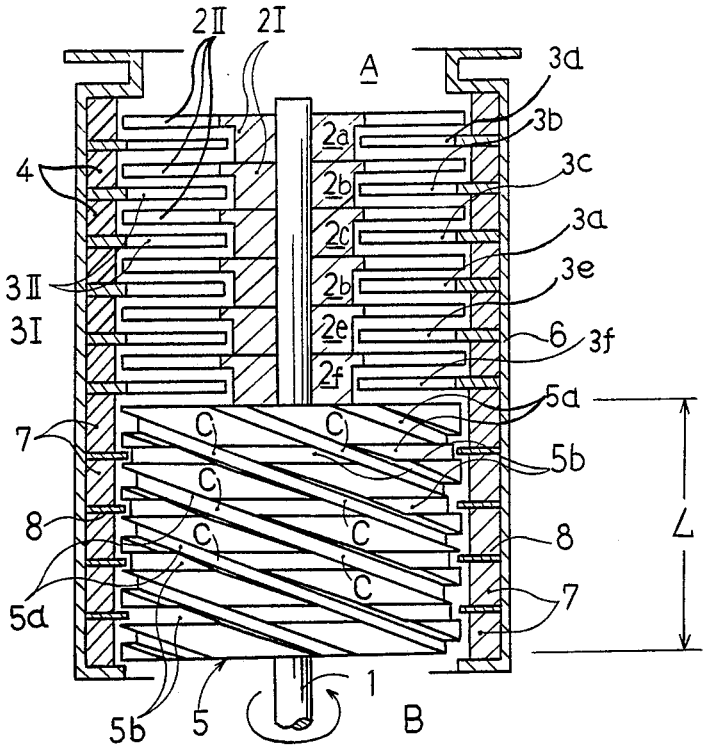
FIG. 4 is a section view of the major portion of the pump as a second example of the present invention (with only the rotor 5 shown by side view).

Although the above first example realizes a simplified and low cost exaustion system, a somewhat complicated but more effective system is presented as a second example of this invention, in which the rotor blades in a compression ratio raising section of the turbomolecular pump shown in FIG. 1 are the thread. Specifically, each of the rotors 2*g*~2*i* in the first example may have four to eight blades to correspond with four to eight thread grooves and the distance between the blades 2 II may be the width of the thread groove. Particularly effective construction will be explained in the following as the second example in which the rotors with thick blades define a cylinder having thread grooves on its outer circumference so as to form a compression ratio raising section. FIGS. 4 illustrate the second example.

Figure 5:
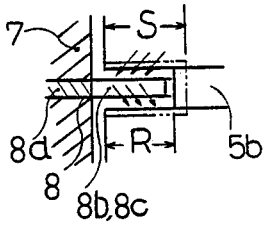
FIG. 5 is an enlarged view showing a part of the pump in FIG. 4
Figure 6:
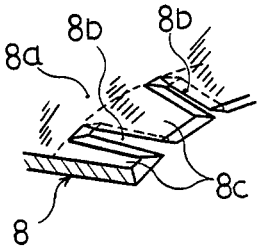
FIG. 6 is a partially broken perspective view which shows the outer appearance of the stator ring shown in FIG. 4.

FIGS. 4 through 6 shows an example of the construction of the turbomolecular pump as the second example of the present invention. This vacuum pump is a hybrid turbomolecular pump comprising a blade group composed of the combination of rotors 2*a*, 2*b*, . . . , 2*f* and stators 3*a*, 3*b*, . . . , 3*f* on the suction port side A and the compression ratio raising section L adjacent said blade group on the exhaust port side B. The blade group in the upper part of the pump comprises a number of alternately arranged rotors 2*a*, 2*b*, . . . , 2*f* and stators 3*a*, 3*b*, . . . , 3*f* each of said rotors having blades 2 II radially projecting, with the specified inclination, from the periphery of the rotor, and a base portion 2I at which the rotor is fit and fixed on the central driving shaft 1, each of said stators having blades 3 II inclined inversely with the blades 2 II of the rotors 2*a*, 2*b*, . . . , 2*f*, and being positioned and fixed as clamped at the base portion 3I by spacers 4, 4 provided on the inner circumferential surface of the outer frame 6 that surrounds the rotors. When said rotor blades 2 II rotate at a high speed, driven through the driving shaft 1, they collide with gas molecules and give axial momentum to othe same, thus generating a forced molecule flow, in cooperation with said stator blades 3 II, from the suction port A at one end toward the exhaust port B at the other end of the pump, so that gas is discharged.

The rotor 5 in the compression ratio raising section L of the pump is installed about the driving shaft 1 with its upper end adjacent the bottom of said blade group. Said rotor 5 is fixed to the driving shaft 1 passing through the center thereof so that it rotates at a high speed together with said rotors 2*a*, 2*b*, . . . , 2*f*. The rotor 5 is provided with an appropriate number of spiral grooves 5*a*. Rotor blades consist of above spiral grooves surface, the depth of said grooves being gradually shallower toward the exhaust port side B, though not shown in the drawings. Said spiral groove 5*a* is oriented so that gas molecules discharged from said blade group are guided along the groove to the exhaust port B as the driving shaft 1 rotates. In addition to said spiral grooves 5a, ring grooves 5b are provided on the circumferential surface of said rotor 5. In general, said ring grooves are provided in plurality and spaced uniformly from one another. These separate ring grooves are formed so that a lower groove is shallower than an upper groove, in proportion to the varied depth of said spiral groove 5a, the depth R of each ring groove 5b being shallower than the depth S of the spiral groove 5a which the ring groove 5b crosses (R<S). Thus, the spiral grooves 5a and the ring grooves 5b cross with each other on the circumferential surface of the rotor 5, producing many intersections C whose depths are the same as that of the spiral grooves where the respective intersections are positioned. The wall or outer frame 6 surrounding said rotor 5 with a small gap therebetween has a number of spacers 7 on its inner circumferential surface. Stator rings 8 project from the spacers into said ring grooves 5b. Each of the stator rings 8 is positioned and fixed, as clamped at its outer circumferential end by said stators 7 the inner circumferential end coming close to the bottom of the ring groove 5b to divide the same perpendicularly to the rotor axis. The portion of the stator ring 8 that protrudes from the inner surface of the spacers 7 has radial slits 8b which incline inversely with said spiral grooves 5a so that a plurality of blades 8c are formed circumferentially, as shown in FIG. 6.

Operation of the turbomolecular pump will be described in the following.

The driving shaft 1 is rotated by a motor accomodated under the driving shaft so that the rotor 2a, 2b, . . . , 2f and the rotor 5 rotate at a high speed. Then, as described above, gas molecules sucked through the suction port A forcedly pass through the blade group and then are guided along the spiral grooves 5a in the rotor 5. Similar to conventional rotors, the rotating rotor 5 collides with the gas molecules and give the same a circumferential momentum along the spiral grooves 5a so that the gas molecules are compressed as flowing toward the exhaust port B. At this time, the intersections C of the spiral grooves serve as nodes to prevent backstreaming of the molecular flow. Conventional hybrid pumps of this kind have had no means to block the molecular flow on the way in the long spiral grooves, permitting backstreaming of the gas molecules in the spiral grooves. In the turbomolecular pump according to the present invention, the spiral grooves 5a are closed by said blades 8c of the stator rings 8 at every intersection C with said ring rooves 5a, and communicate through the slits 8b that have inverse inclination with the spiral grooves as shown in FIG. 2, so that each of the intersections C can serve as a node to block the backstreaming of the molecular flow. Since each spiral groove 5a has many intersections (nodes) C between the upper end on the suction port side A and the lower end on the exhaust port side B, there is no possibility of backstreaming phenomenon even when evacuation has been performed nearly to the limit vacuum achievable.

Moreover, according to this example, the side wall of the rotor 5 provided with the spiral grooves 5a and the blades 8c provided with the slits 8 of the stator rings 8 have a function to mechanically blow the gas molecules downwardly, as the blade group composed of the rotor blades 2II and the stator blades 3 II does, thus enhancing the pumping characteristics of the pump. Next, a modification of the turbomolecular pump of the second example described above will be explained with reference to FIGS. 7 through 9. The reference numerals and symbols donate the same parts as for the preceding example. The modified example is different from the preceding example in the following points: First, the depth of the spiral grooves (thread grooves) 5a' provided in the rotor 5 is less than that of the ring grooves 5b' also provided in the rotor 5 (R>S). Second, the stator rings 8' projecting into the ring grooves 5b' has no slit, and the stator rings whose projecting length varies according to the depth of the ring grooves 5b' close the spiral grooves 5a' at every intersection C with the ring grooves 5b' to the deepter level. The molecular flow in the spiral grooves 5a' is forced to make a detour at every intersection C where the groove depth is the same as that of the ring groove 5b'. Thus, each of the intersections C can provide a very powerful and accurate backstreaming preventive mechanism. To accelerate and help said detour movement of the gas molecules, each of the stator rings 8' in this example is provided with helical grooves 8d and 8f on the top face and the bottom face respectively. The helical grooves 8d on the top face and the helical grooves 8f on the bottom face are oriented inversely with each other so that the former guides the molecular flow from the outside to the inside while the latter guides the molecular flow vice versa, as shown in FIGS. 8 and 9.

Figure 7:
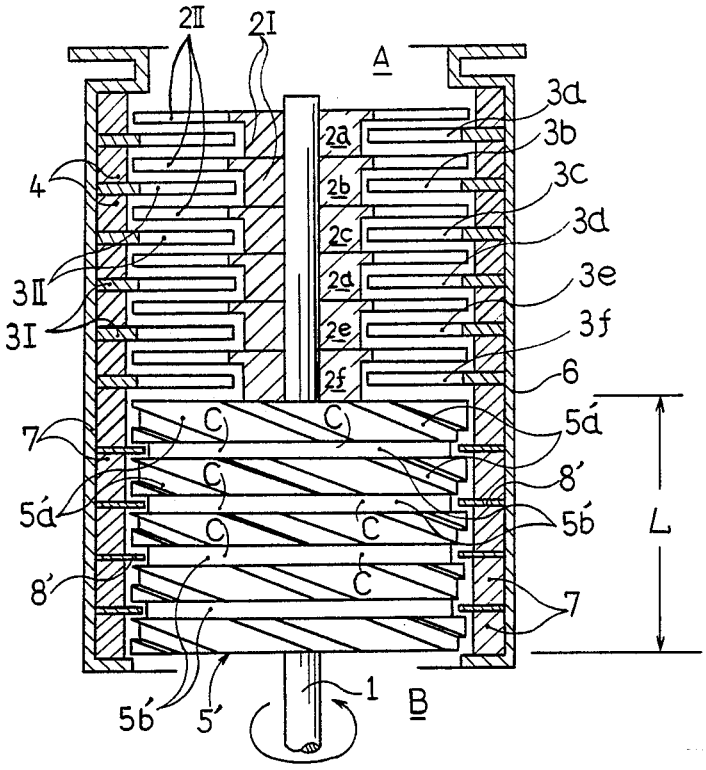
FIG. 7 is a section view of the major portion of the pump as another example of the present invention (with only the rotor 5 shown by side view).
Figure 8:
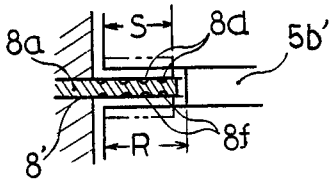
FIG. 8 is an enlarged view showing a part of the pump in FIG. 7.
Figure 9:
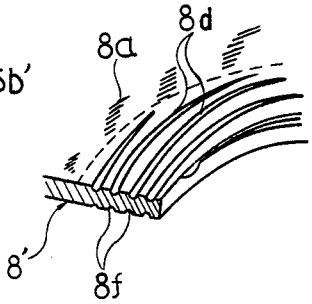
FIG. 9 is a partially broken perspective view which shows the outer appearance of the stator ring shown in FIG. 7.

It is incontroversial that the example shown in FIGS. 7 through 9 is superior in the backstreaming prevention but inferior in the pumping performance to the example shown in FIGS. 4 through 6. The spiral grooves 5a, 5a' and ring grooves 5b, 5b' are shown as enlarged for convenience. Actually, they may have smaller widths and be provided closer to one another. The inclination angle of each groove 5a or 5a' and the interval between the ring grooves 5b or 5b' need not be limited to those of the examples. For instance, the interval between the ring grooves 5b or 5b' may be gradually increased toward the exhaust port side B so that the compression efficiency of the rotor 5 is improved. The second example described above has eliminated the disadvantages while retaining the advantages of conventional hybrid turbomolecular pumps. Specifically, provided with a backstreaming preventive mechanism, a high-efficiency turbomolecular pump has been realized which attains good pumping speed performance even for a low vacuum range, without deteriorating the ultimate vacuum achieved.

According to the present invention, as described above, an improvement has been made in the blade thickness of each rotor in the blade group so that a part of the axial length of the blade group provides a compression ratio raising function. As a result, the pump body itself can effect increase in the compression ratio without a separate compression ratio raising means. Thus, the turbomolecular pump with a high pumping speed even for a low vacuum range can be achieved.

What is claimed is:

1. A turbomolecular pump comprising;

(a) a housing having a suction port and an exhaust port;

(b) a pump comprising a group of axial blades which is arranged adjacent to the suction port, wherein the pump consists of a group of rotors and stators arranged alternately; and (c) a special composite pump arranged in the housing adjacent to the exhaust port, wherein the special composite pump is a combination of a rotor blade body having spiral grooves which are separated by a plurality of ring grooves into multi-stages, said rotor body being formed to be an integral connection of a plurality of cylindrical bodies, and a stator blade body, the blades of which are inserted into the ring grooves of the rotor body.

2. A turbomolecular pump according to claim 1 wherein said spiral grooves of said cylindrical rotor region are deeper than said ring grooves.

3. A turbomolecular pump according to claim 2 wherein said second set of stators comprise a plurality of axially spaced vanes.

4. A turbomolecular pump according to claim 1 wherein said ring grooves are deeper than said spiral grooves.

5. A turbomolecular pump according to claim 4 wherein said plurality of second set of stators have helical grooves formed on their opposing surfaces.

* * * * *